US009304430B2

(12) United States Patent
Matsumoto et al.

(10) Patent No.: US 9,304,430 B2
(45) Date of Patent: Apr. 5, 2016

(54) IMAGE FORMING APPARATUS WITH DEVELOPING UNIT SEPARABLE FROM PHOTOSENSITIVE MEMBER

(71) Applicant: CANON KABUSHIKI KAISHA, Tokyo (JP)

(72) Inventors: Yasuhisa Matsumoto, Suntou-gun (JP); Keita Sato, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/291,945

(22) Filed: May 30, 2014

(65) Prior Publication Data

US 2014/0369704 A1 Dec. 18, 2014

(30) Foreign Application Priority Data

Jun. 14, 2013 (JP) ..... 2013-126122

(51) Int. Cl.

| | |
|---|---|
| ***G03G 15/00*** | (2006.01) |
| ***G03G 15/043*** | (2006.01) |
| *G03G 15/01* | (2006.01) |
| *G03G 21/18* | (2006.01) |

(52) U.S. Cl.
CPC ..... *G03G 15/043* (2013.01); *G03G 15/0121* (2013.01); *G03G 21/1892* (2013.01)

(58) Field of Classification Search
CPC ..... G03G 15/043; G03G 15/0813; G03G 2215/0154
See application file for complete search history.

(56) References Cited

U.S. PATENT DOCUMENTS 5,565,972 A * 10/1996 Honda et al. ..... 399/384
2013/0108290 A1* 5/2013 Funatani et al. ..... 399/43

FOREIGN PATENT DOCUMENTS

| | | | |
|---|---|---|---|
| JP | 08-076538 | A | 3/1996 |
| JP | 09-230259 | A | 9/1997 |
| JP | 2006-292868 | A | 10/2006 |
| JP | 2006-349763 | A | 12/2006 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes: a scanning unit configured to scan a photosensitive member with light; a developing unit configured to develop a latent image; a driving unit configured to cause the developing unit to come into contact with the photosensitive member or to be separated from the photosensitive member; and a control unit configured to let the scanning unit perform a preparation operation, in order for the scanning unit to form the latent image. The developing unit is separated from the photosensitive member while the preparation operation of the scanning unit is performed, and the control unit is configured to start, before the preparation operation of the scanning unit is completed, controlling the driving unit to bring the separated developing unit into contact with the photosensitive member.

15 Claims, 14 Drawing Sheets

F I G. 10A

| ADDRESS | |
|---|---|
| 00 | SERIAL NUMBER |
| 01 | PRINT COUNT |
| | ⋮ |

F I G. 10B

| ADDRESS | |
|---|---|
| 00 | YELLOW: PROCESS CARTRIDGE SERIAL NUMBER |
| 01 | YELLOW: PROCESS CARTRIDGE PRECEDING CONTROL TIME PERIOD |
| 02 | CYAN: PROCESS CARTRIDGE SERIAL NUMBER |
| 03 | MAGENTA: PROCESS CARTRIDGE SERIAL NUMBER |
| 04 | BLACK: PROCESS CARTRIDGE SERIAL NUMBER |
| | ⋮ |

IMAGE FORMING APPARATUS WITH DEVELOPING UNIT SEPARABLE FROM PHOTOSENSITIVE MEMBER

BACKGROUND OF THE INVENTION

1. Field of the Invention

The present disclosure relates to an image forming apparatus that transfers a developer image formed on a photosensitive member to a recording medium.

2. Description of the Related Art

As image forming apparatuses, there are provided apparatuses that form an electrostatic latent image on a photosensitive member and develop the formed electrostatic latent image using a developing unit including a developing roller, thereby forming a visible image. If the developing roller and the photosensitive member are left in the state of being in contact with each other for a prolonged time, both the developing roller and the photosensitive member will locally deform, which may cause a defect image. Furthermore, if the developing roller and the photosensitive member that are in the state of being in contact with each other are rotated more than needed, the photosensitive member will wear due to friction between the developing roller and the photosensitive member, and the lifespan of the photosensitive member will be reduced. Accordingly, Japanese Patent Laid-Open No. 2006-292868 discloses an image forming apparatus that is configured to perform operations for bringing the developing roller into contact with and separating the developing roller from the photosensitive member, thereby reducing the amount of time during which a photosensitive member and a developing roller are in contact with each other.

Furthermore, as disclosed in Japanese Patent Laid-Open No. 09-230259, there is provided an image forming apparatus in which a scanner motor rotates a polygon mirror in order to scan a photosensitive member. Since the scanner motor has a high inertia and it takes a long time until the scanner motor stably rotates, it is necessary to start driving the scanner motor simultaneously with a printing instruction. Furthermore, in order for a light-receiving sensor to detect the rotating speed of the scanner motor, a semiconductor laser is turned on. When the rotating speed of the scanner motor becomes stable at a target rotating speed, turning on and off of the semiconductor laser is performed in accordance with synchronization signals input in the light-receiving sensor, preventing the photosensitive member from being irradiated with light (referred to as unblanking light emission).

As describe in Japanese Patent Laid-Open No. 2006-292868, the developing roller is separated from the photosensitive member while no image forming processing is being executed, and the developing roller is brought into contact with the photosensitive member at the start of the image forming processing. When the scanner motor starts rotating at the start of the image forming processing, the light source emits light for the detection of the rotating speed of the scanner motor. During this light emission, the photosensitive member is exposed to the light. Accordingly, if the developing roller and the photosensitive member come into contact with each other during the light emission, developer adheres to the exposed position of the photosensitive member. The developer adhering to the photosensitive member will eventually adhere to the rear face of a recording material and, in other words, cause marking on the back of the material. Therefore, it is necessary to start control of the developing roller such that the developing roller comes into contact with the photosensitive member after the rotating speed of the scanner motor becomes stable and the light source is shifted to unblanking light emission.

Consequently, it takes a long time from the start of the image forming processing until when the developing roller is brought into contact with the photosensitive member, that is, from the start of the image forming processing until it is possible to form a developer image.

SUMMARY OF THE INVENTION

According to an aspect of the present invention, an image forming apparatus includes: a photosensitive member; a scanning unit including a light source, and configured to scan the photosensitive member with light from the light source and to form an electrostatic latent image; a developing unit configured to develop the electrostatic latent image by contacting with the photosensitive member; a driving unit configured to drive the developing unit, and to cause the developing unit to come into contact with the photosensitive member or to be separated from the photosensitive member; and a control unit configured to let the scanning unit perform a preparation operation, in order for the scanning unit to form the electrostatic latent image based on image data. The developing unit is separated from the photosensitive member while the preparation operation of the scanning unit is performed, and the control unit is further configured to start, before the preparation operation of the scanning unit is completed, controlling the driving unit to bring the separated developing unit into contact with the photosensitive member.

Further features of the present invention will become apparent from the following description of exemplary embodiments with reference to the attached drawings.

BRIEF DESCRIPTION OF THE DRAWINGS

FIGS. 10A and 10B are diagrams illustrating information stored in a nonvolatile memory according to an embodiment.

DESCRIPTION OF THE EMBODIMENTS

Hereinafter, exemplary embodiments of the present invention will be described with reference to the accompanying drawings. Note that in the following figures, constituent components that are not essential to the description of the embodiments are omitted. Furthermore, the following embodiments are examples, and do not limit the scope of the present invention.

First Embodiment

Figure 1:
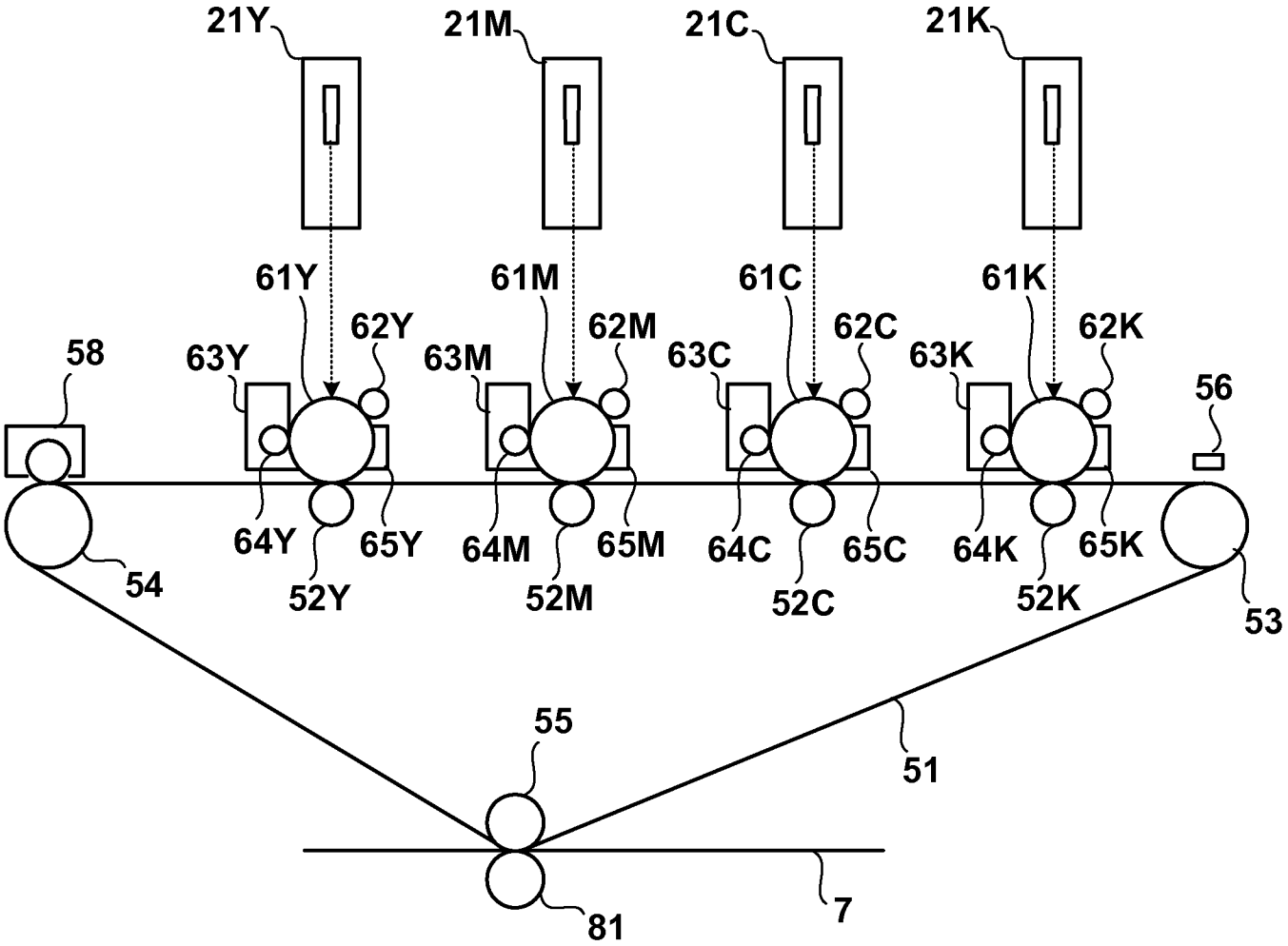
FIG. 1 is a diagram schematically illustrating a configuration of an image forming apparatus according to an embodiment.

FIG. 1 is a schematic cross-sectional view of an image forming apparatus according to the present embodiment. Note that, in the following figures, members with reference numerals including letters Y, M, C, and K at the end are members that respectively form yellow, magenta, cyan, and black developer images on an intermediate transfer belt 51. Furthermore, in the following description, when there is no need to distinguish the colors of the developer images, reference numerals without Y, M, C, and K are used. A charging roller 62 outputs a charging bias and uniformly charges a surface of a photosensitive member 61. An exposing unit 21 is a scanner for the photosensitive member 61, and is configured to scan with light the corresponding photosensitive member 61 depending on the image to be formed, and to expose the photosensitive member 61 to the light, thereby forming an electrostatic latent image on the photosensitive member 61. A developing device 63 includes toner (developer) of the corresponding color and a developing roller 64, and causes the toner to adhere to the electrostatic latent image of the corresponding photosensitive member 61 using a developing bias output by the developing roller 64, thereby visualizing the electrostatic latent image as a toner image (developer image). Note that the developing roller 64 is configured to be situated in two states, these states being a contact state, in which the developing roller 64 is brought into contact with the photosensitive member 61, and a separate state, in which the developing roller 64 is separated from the photosensitive member 61. A primary transfer roller 52 outputs a primary transfer bias and transfers the toner image of the corresponding photosensitive member 61 to the intermediate transfer belt 51. Note that a multicolor toner image can be formed by transferring toner images of various colors to the intermediate transfer belt 51, with the toner images of various colors superposed on one another. A cleaner 65 removes toner that was not transferred to the intermediate transfer belt 51 from the photosensitive member 61 and remains on the surface of the photosensitive member 61. Note that the photosensitive member 61, the charging roller 62, the developing device 63, and the cleaner 65 that form the same color toner image are configured as an integral-type process cartridge that is attachable to and detachable from the image forming apparatus.

The intermediate transfer belt (intermediate transfer body) 51 is tensioned over three rollers, namely, a driving roller 53, a tension roller 54, and a secondary transfer opposite roller 55, and is rotated by the rotation of the driving roller 53. The secondary transfer roller 81 outputs a secondary transfer bias, and transfers the toner images of the intermediate transfer belt 51 to a recording material that is being conveyed on a conveyance path 7. The recording material to which the toner images are transferred is then subjected to fixation of the toner images in a fixing unit (not shown), and is discharged out of the image forming apparatus. Furthermore, a cleaner 58 removes toner that was not transferred to the recording material and remains on the intermediate transfer belt 51. Note that, in the vicinity of the driving roller 53, two detection sensors 56 are arranged at both ends of the driving roller 53 in the longitudinal direction. The detection sensors 56 detects a toner image for correction control that is formed on the intermediate transfer belt 51.

Figure 2:
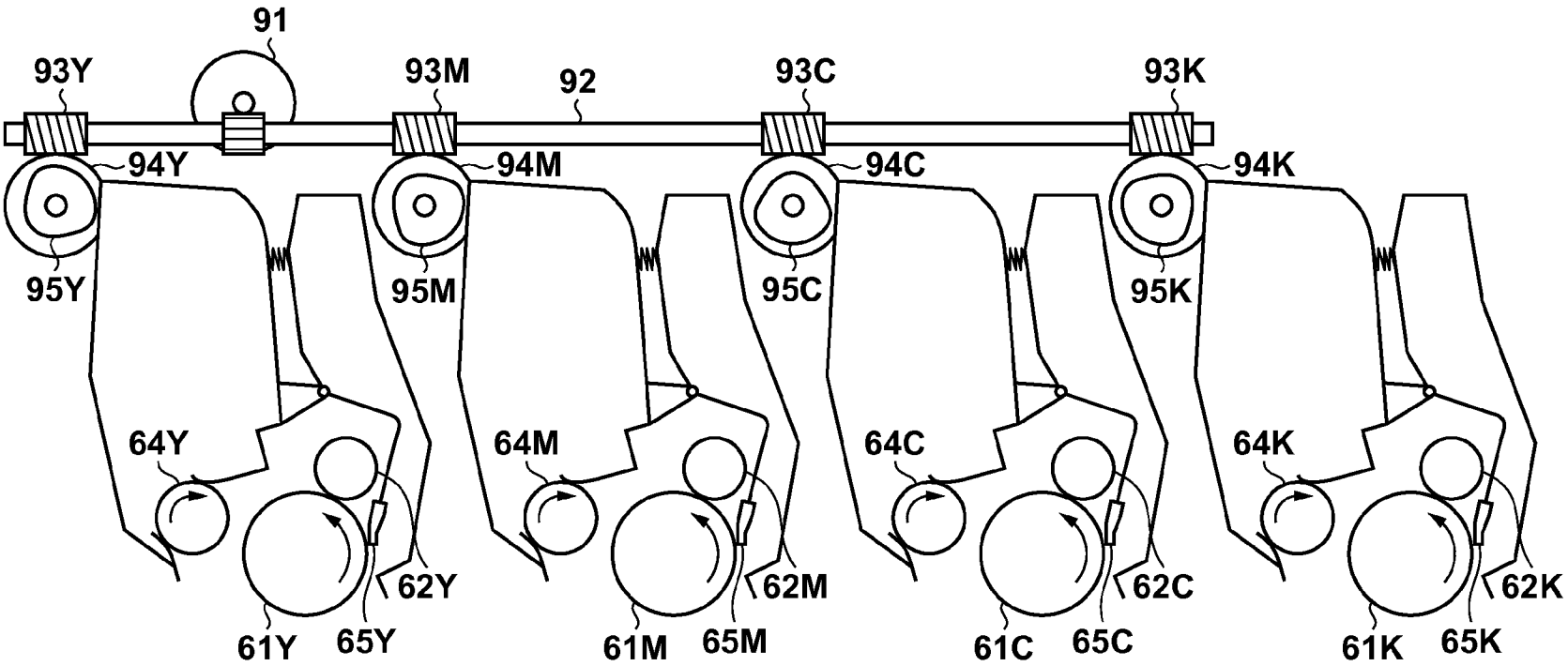
FIG. 2 is a diagram illustrating a configuration of a mechanism for bringing photosensitive members into contact with and separating them from developing rollers, according to an embodiment.

Subsequently, a configuration for switching between the contact and separate states of the developing rollers 64 and the photosensitive members 61 will be described with reference to FIG. 2. A stepping motor 91 is connected to a shaft 92 via a worm type pinion gear. The shaft 92 is provided with worm gears 93 for respectively driving cam gears 94, and is configured such that rotation of the shaft 92 changes phases of cams 95 of the cam gears 94. With the change of the phases of the cams 95, it is possible to bring the developing rollers 64 into contact with the photosensitive members 61, or to separate the developing rollers 64 from the photosensitive members 61. It is also configured such that, when the phases of the cams 95 reach a predetermined phase before the developing rollers 64 are brought into contact with the photosensitive members 61, the developing rollers 64 are coupled to clutches (not shown), and are driven to rotate.

Figure 3:
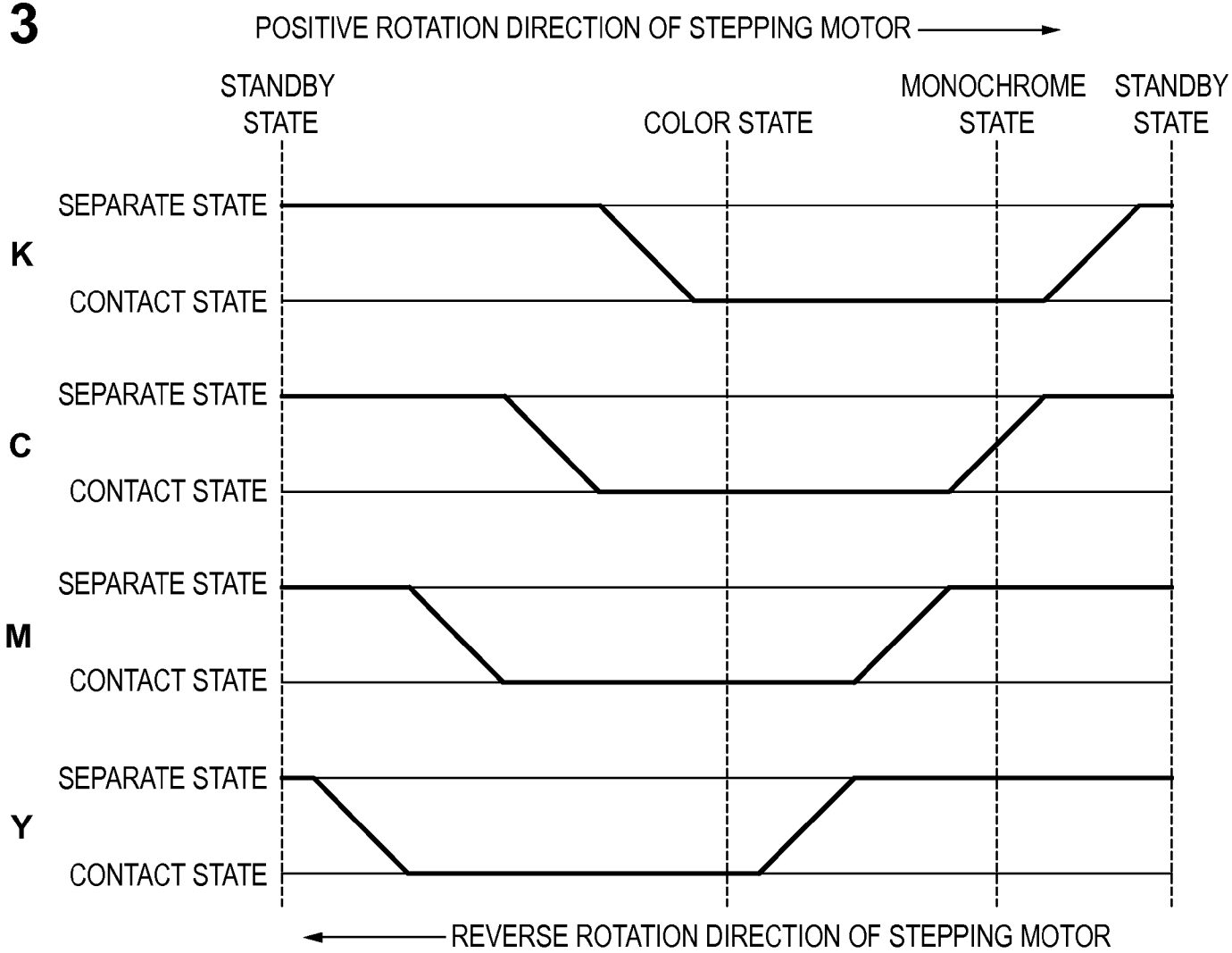
FIG. 3 is a cam diagram according to an embodiment.

Subsequently, the relationship between the rotating state of the stepping motor 91 and the states of the developing rollers 64 will be described with reference to the cam diagram of FIG. 3. In FIG. 3, standby state refers to a state in which all the developing rollers 64Y, 64M, 64C, and 64K are separated from the respective corresponding photosensitive members 61, and is set while no image formation is performed. Furthermore, contact state refers to a state in which the developing rollers 64 are in contact with the respective photosensitive member 61, and any other state than the contact state is a separate state. That is, in FIG. 3, the line segment from a position indicated with the separate state toward a position indicated with the contact state belongs to the separate state. Note that indications with regard to "separate" and "contact" are also applied to other figures. Furthermore, in FIG. 3, the letters Y, M, C, and K respectively denote the states of the developing rollers 64Y, 64M, 64C, and 64K. For example, when the stepping motor 91 is rotated in the positive direction from the standby state, the developing rollers 64Y, 64M, 64C, and 64K are shifted to the contact state in this order. Note that a state in which all the developing rollers 64Y, 64M, 64C, and 64K are in contact with the respective corresponding photosensitive members 61 is referred to as a color state. When forming a color image, the developing rollers are shifted from the standby state to the color state, and the developing rollers are subjected, in order of completion of the shift to the contact state, to image formation of the respective corresponding colors, that is, formation of electrostatic latent images, and to development of the formed electrostatic latent images. When the image formation is completed, the stepping motor 91 is rotated in the positive direction to separate the developing rollers 64Y, 64M, 64C, and 64K from the respective corresponding photosensitive members 61 in this order, and the developing rollers are shifted from the color state to the standby state.

Furthermore, as shown in FIG. 3, only the developing roller 64K that corresponds to black can be in the contact state depending on the rotating state of the stepping motor 91. The state in which only the developing roller 64K corresponding to black is in contact with the corresponding photosensitive member 61 is referred to as monochrome state. Note that FIG. 2 shows the monochrome state. For example, when forming a monochrome image, the stepping motor 91 is rotated in the reverse direction to shift the developing rollers from the standby state to the monochrome state, and image formation is performed. When the image formation is completed, the stepping motor 91 is rotated in the positive direction to shift the developing rollers from the monochrome state to the standby state.

The rotating direction of the stepping motor 91 is different between when forming the color image and when forming the monochrome image. As is clear from the cam diagram of FIG. 3, if the position of the standby state is set near the color state, it will take a long time until the developing rollers are shifted to the monochrome state when forming a monochrome image. On the other hand, if the position of the standby state is set near the monochrome state, it takes a long time until the developing rollers are shifted to the color state when forming a color image.

Figure 4:
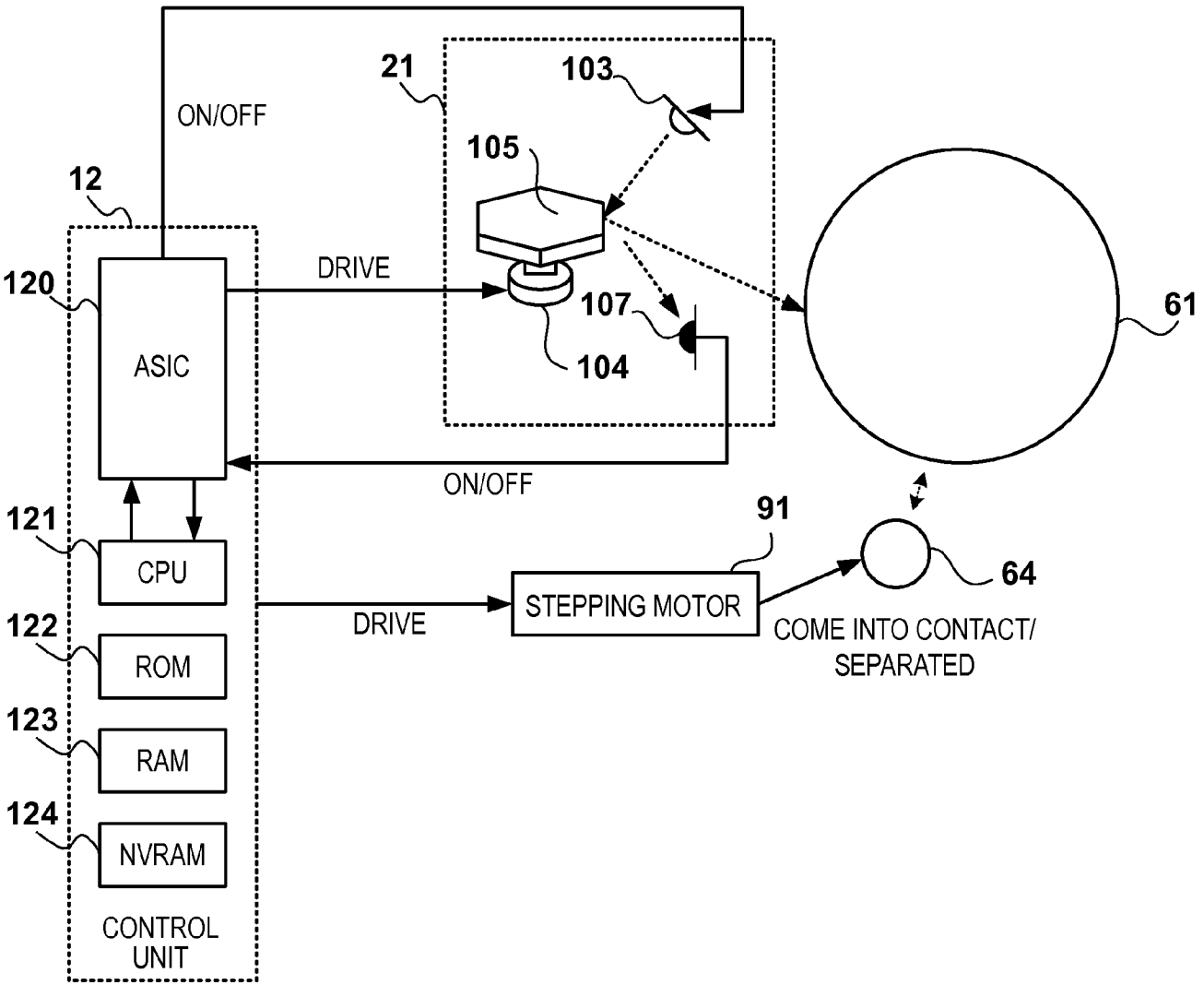
FIG. 4 is a diagram illustrating a control configuration according to an embodiment.

FIG. 4 is a diagram illustrating a control configuration according to the present embodiment. In FIG. 4, a control unit 12 performs overall control of the image forming apparatus, and a CPU 121 executes a program stored in a ROM 122, and uses data for the control of the image forming apparatus, the data being stored also in the ROM 122. Furthermore, the data for use in the control may also be stored in a main body nonvolatile memory (NVRAM) 124. Furthermore, a RAM 123 is used for temporary storage of data by the CPU 121. Furthermore, the control is partially performed by an ASIC 120. Note that although, in the example of FIG. 4, the control unit 12 includes the CPU 121 and the ASIC 120, the control unit 12 may only include the CPU 121 or the ASIC 120.

Moreover, in the present embodiment as shown in FIG. 4, the exposing unit 21 includes a light source 103, a rotary polyhedron 105 that is driven to rotate by a scanner motor 104, and a light-receiving sensor 107. Light emitted by the light source 103 is reflected on a reflecting surface of the rotary polyhedron 105 that is rotating, and the photosensitive member 61 is exposed to the light and scanned. Furthermore, the exposing unit 21 is configured such that the reflected light is received by the light-receiving sensor 107, instead of the photosensitive member 61, depending on the direction of the reflecting surface of the rotary polyhedron 105 on which the light is reflected. In the present example, the ASIC 120 controls the rotating speed of the scanner motor 104 and the turning on/off of the light source 103. Note that the CPU 121 sets, for the ASIC 120, a light emitting method of the light source 103, such as, for example, forced light emission, non-light emission, or blinking light emission. Furthermore, the light-receiving sensor 107 outputs, to the ASIC 120, a signal that indicates a light-receiving state, that is, whether or not the light-receiving sensor 107 has received light. Moreover, the control unit 12 controls the stepping motor 91 so that the developing roller 64 is brought into contact with the photosensitive member 61 or the developing roller 64 is separated from the photosensitive member 61.

Figure 5:
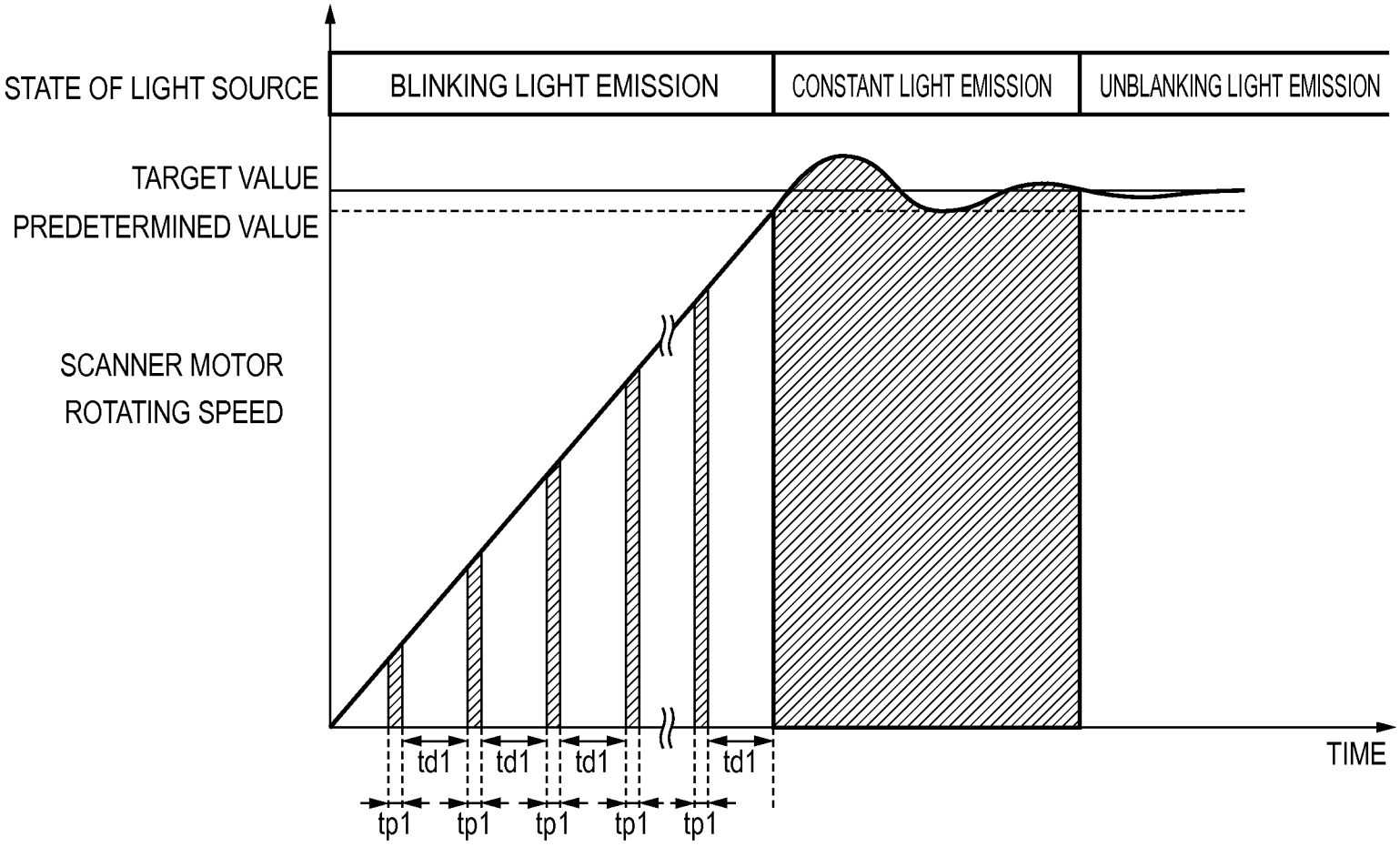
FIG. 5 is a diagram illustrating light emission timings of a light source while a scanner motor is activated, according to an embodiment.

FIG. 5 shows light emission timings of the light source 103 while the scanner motor 104 is activated. The control unit 12 increases the rotating speed of the scanner motor 104 to a target value. The control unit 12 also controls the light source 103 to emit light in a blinking manner while increasing the rotating speed of the scanner motor 104. Here, tp1 denotes light emission period and td1 denotes non-light emission period during blinking light emission. Note that the light emission period tp1 is set to be twice or longer than a cycle in which the light-receiving sensor 107 detects light when the scanner motor 104 rotates at the target rotating speed. Note that the light emission period tp1 and the non-light emission period td1 are set to be shorter than a time period that the scanner motor 104 needs to reach the target rotating speed. The control unit 12 detects the rotating speed of the scanner motor 104 based on the cycle in which the light-receiving sensor 107 detects light. When the rotating speed of the scanner motor 104 reaches a predetermined value that is lower than the target value, the control unit 12 controls the light source 103 to emit light constantly, and adjusts the rotating speed of the scanner motor 104 to the target rotating speed. When the rotating speed of the scanner motor 104 has reached the target value, the control unit 12 controls the light source 103 to perform unblanking light emission such that the light source 103 emits light only during predetermined periods including timings at which the light-receiving sensor 107 detects light. The unblanking light emission means that the light source 103 emits light at timings at which the photosensitive member is not scanned. Furthermore, a time period from the start of rotation of the scanner motor 104 until when the unblanking light emission is performed is a time period in which a preparation operation of the exposing unit 21 is performed. Note that the hatched areas of FIG. 5 indicate light emission periods of the light source 103, within a period in which the light source 103 is controlled so as to perform blinking light emission and constant light emission.

As described above, it is necessary to turn on the light source 103 when the scanner motor 104 is activated. Here, in the case of unblanking light emission, the light source 103 emits light at timings at which the light-receiving sensor 107 detects the light, and thus the photosensitive member 61 is not exposed to the light. However, in a time period before the unblanking light emission, such as for example, a time period in which the light source 103 emits light constantly, the photosensitive member 61 is exposed to light reflected on the rotary polyhedron 105 and the light forms an electrostatic latent image. Therefore, if the developing roller 64 is in contact with the photosensitive member 61, the electrostatic latent image of the photosensitive member 61 will be developed into a toner image, and the toner image will be transferred to the intermediate transfer belt 51. When the toner image of the intermediate transfer belt 51 reaches the position opposite to the secondary transfer roller 81, the toner will adhere to the secondary transfer roller 81. The toner that has adhered to the secondary transfer roller 81 will adhere, at the time of printing, to the surface of the recording material that is opposite to the printed surface, and, in other words, cause marking on the back of the material.

Figure 6:
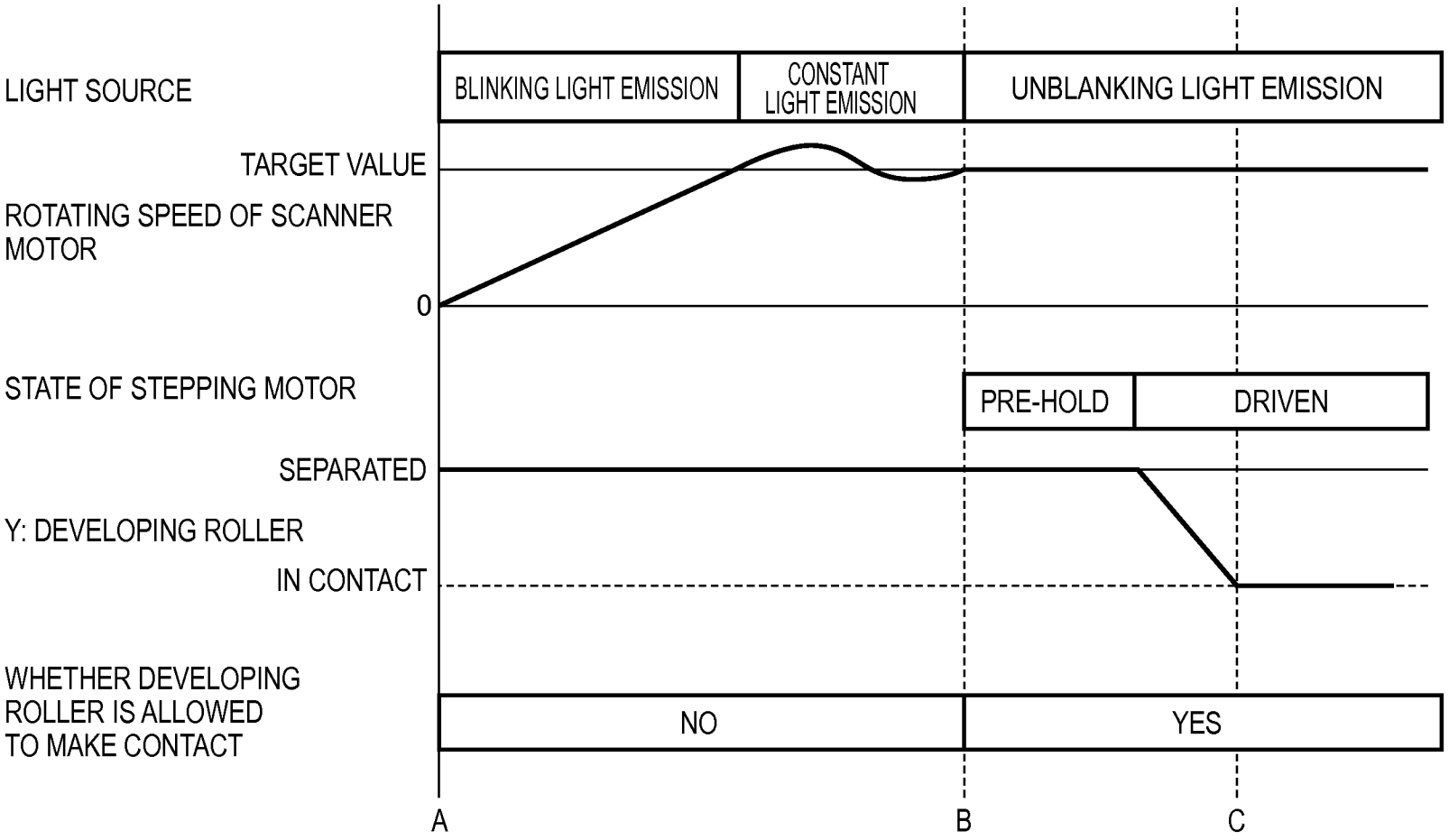
FIG. 6 is a diagram illustrating a relationship between control of the scanner motor and control in which the developing roller is brought into contact with the photosensitive member, according to an embodiment.

A method for preventing marking on the back of the material is to bring the developing roller 64 into contact with the photosensitive member 61 after the light source has shifted to unblanking light emission. FIG. 6 is a diagram illustrating the relationship between control of the scanner motor 104 and control in which the developing roller 64 is brought into contact with the photosensitive member 61. With the start of the image forming processing at a timing A, the control unit 12 starts rotating the scanner motor 104, and, when the rotating speed of the scanner motor 104 reaches a target value, the control unit 12 switches the light source 103 so as to perform unblanking light emission. At timing B at which the state of the light source is switched to unblanking light emission, the control unit 12 starts control of the stepping motor 91 so that the developing roller 64 is put into the contact state. Here, the control unit 12 first pre-holds the stepping motor 91 and, after the pre-hold operation is completed, actually drives the stepping motor 91 to rotate and to move the developing roller 64 toward the photosensitive member 61. Note that pre-hold refers to control processing for recognizing the current phase of the stepping motor 91, and corresponds to preparation processing performed before the stepping motor 91 is actually rotated. The control unit 12 performs processing for forming a toner image when the developing roller 64 is put into the contact state. That is, when the developing roller 64 is put into the contact state, the control unit 12 transmits, to a controller (not shown), a signal for requesting transmission of image data. The control unit 12 lets the exposing unit 21 scan and expose the photosensitive member 61 according to the image data received in response to the signal, thereby forming an electrostatic latent image on the photosensitive member 61, and the control unit 12 lets the developing device 63 develop the electrostatic latent image. Note that in the control shown in FIG. 6, a time period between the timing A and the timing C is necessary from the start of the printing processing, that is, image forming processing (timing A) until when the developing roller 64 is brought into contact with the photosensitive member 61. This time period is shortened in the present embodiment.

Figure 7:
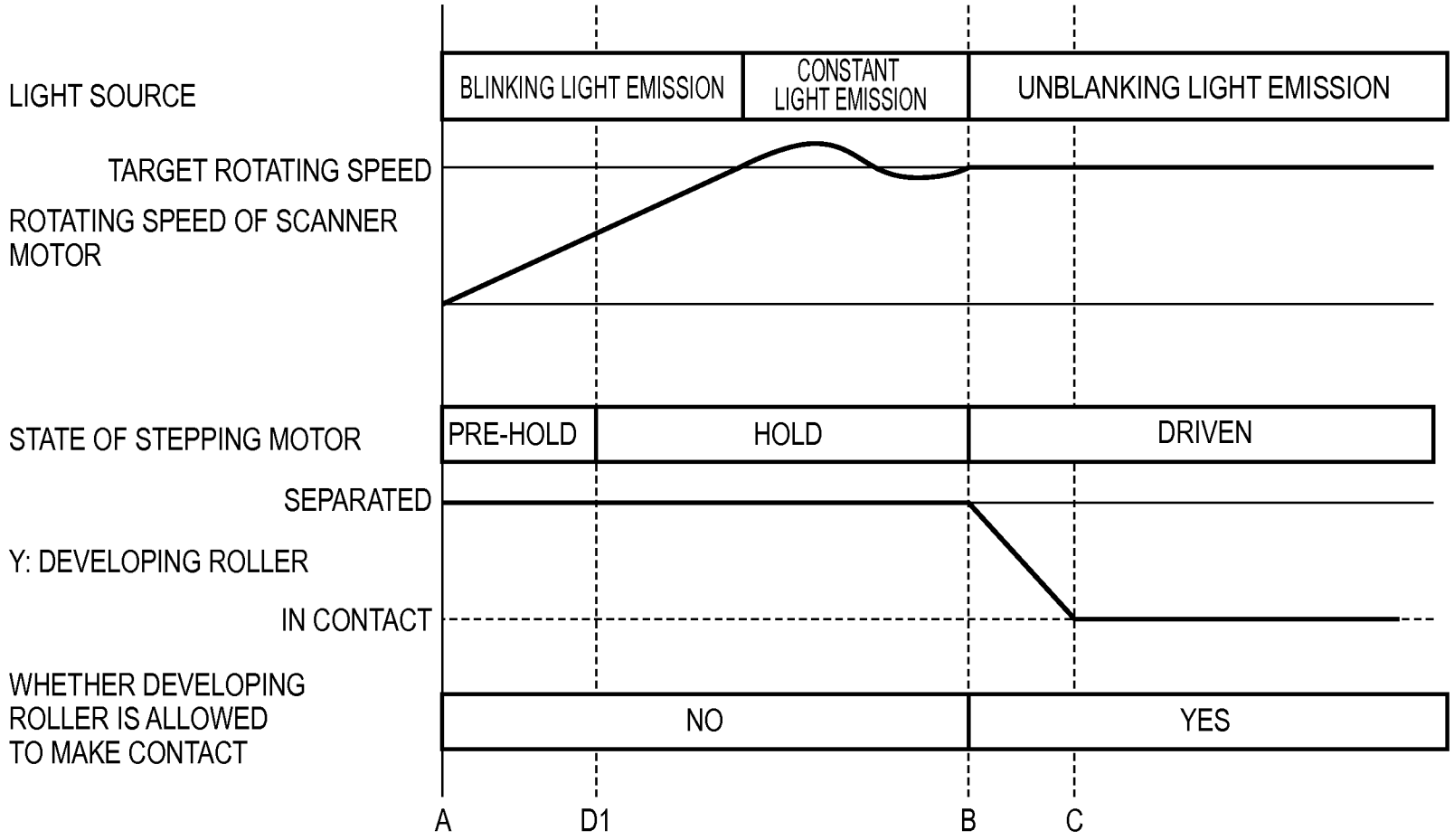
FIG. 7 is a diagram illustrating control in which the developing roller is brought into contact with the photosensitive member, according to an embodiment.

FIG. 7 is a diagram illustrating control of contact of the developing roller 64 according to the present embodiment. As shown in FIG. 7, the control of the present embodiment differs from that of FIG. 6 in that the control unit 12 starts controlling the stepping motor 91 so as to be activated, at the start of the image forming processing, that is, at the start of the rotation of the scanner motor 104. Note that the control unit 12 performs control such that, when the pre-holding of the stepping motor 91 ends at a timing D1, the stepping motor 91 is stopped (hold state in the figure) while maintaining excitation of the stepping motor 91, instead of being driven to rotate. Then, at the timing B at which the state of the light source 103 is switched to unblanking light emission, the control unit 12 starts driving the stepping motor 91 to rotate, and puts the developing roller 64 into the contact state at the timing C. At the timing C, the control unit 12 transmits, to a controller (not shown), a signal for requesting transmission of image data, and performs formation and development of an electrostatic latent image based on the image data received in response to the signal. With the above-described configuration, it is possible to rotate the stepping motor 91 so as to move the developing roller 64 toward the photosensitive member 61 immediately after the state of the light source is switched to unblanking light emission. In the control of FIG. 7, a time period until the developing roller 64 is put into the contact state can be shortened by a time period needed for pre-holding the stepping motor 91, as compared with the control of FIG. 6.

Second Embodiment

Figure 8:
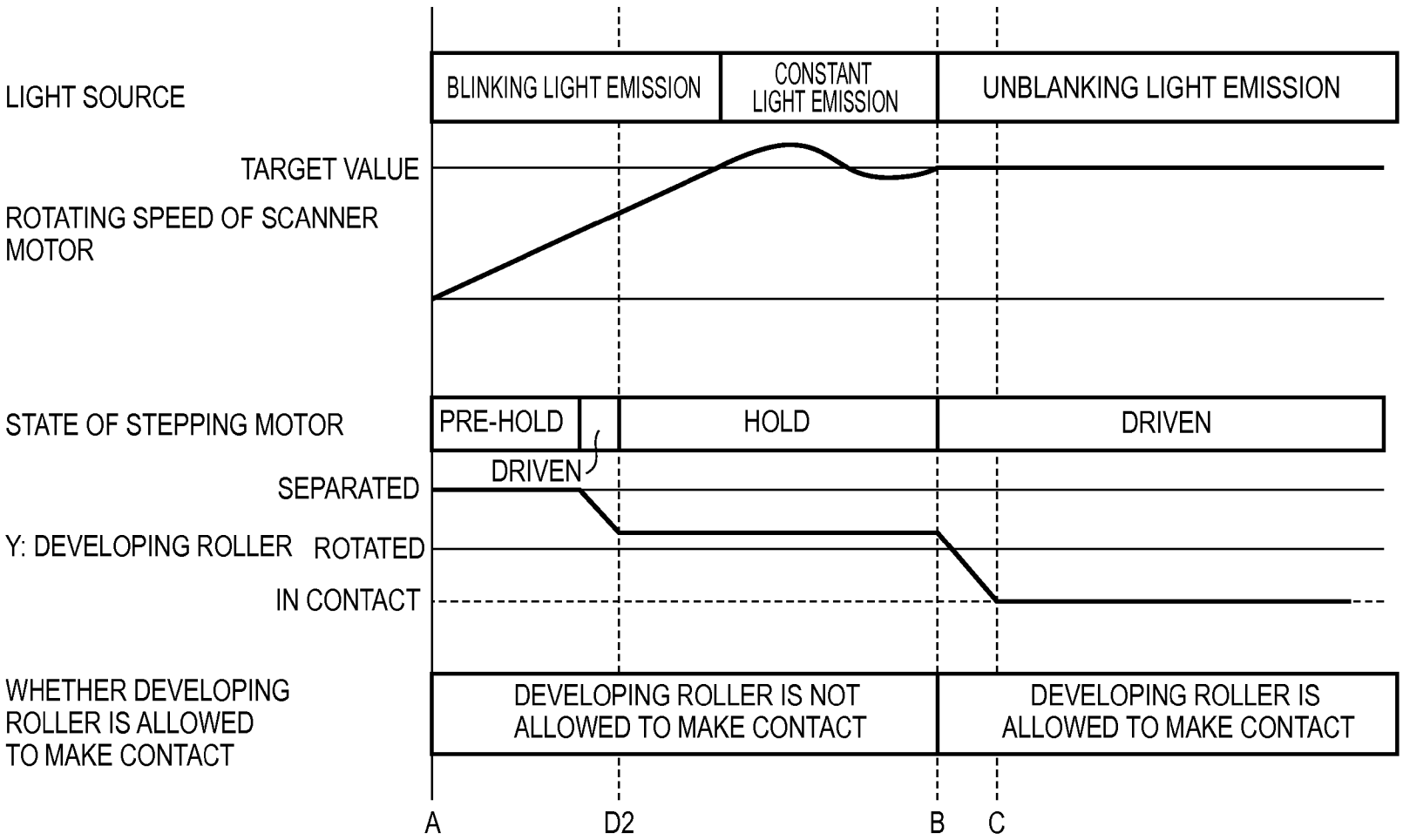
FIG. 8 is a diagram illustrating control in which the developing roller is brought into contact with the photosensitive member, according to an embodiment.

Subsequently, a second embodiment will be described, focusing on differences from the first embodiment. FIG. 8 is a diagram illustrating control of contact of the developing rollers 64 according to the present embodiment. Similarly to the first embodiment, the control unit 12 according to the present embodiment starts control of the stepping motor 91 at the start of rotation of the scanner motor 104. However, in contrast to the first embodiment, after the pre-hold operation is completed, the control unit 12 rotates the stepping motor 91 so as to move the developing roller 64 toward the photosensitive member 61, and then brings the stepping motor 91 into a hold state. As shown in FIG. 8, a position at which the developing roller 64 is stopped while the stepping motor 91 is in the hold state is located before the developing roller 64 is coupled to the clutch and rotates. Hereinafter, a time period starting from the start of control of the stepping motor 91 until when the stepping motor 91 is put into the hold state, during which pre-holding and rotating the stepping motor 91 takes place, is referred to as a preceding control time period Y. Note that a method for determining a preceding control time period Y will be described later. Then, the control unit 12 restarts driving the stepping motor 91 to rotate at the timing B at which the state of the light source 103 is switched to the unblanking light emission, puts the developing roller 64 into the contact state at the timing C, and starts formation of a toner image on the photosensitive member 22. With this configuration, it is possible to shorten the time period from switching to unblanking light emission until when the developing roller 64 is put into the contact state, as compared with that in the first embodiment.

Subsequently, a method for determining a preceding control time period Y is described. The control unit 12 measures an amount of time D, which is from the start of control of the stepping motor 91 until a yellow toner image formed on the intermediate transfer belt 51 is detected by the detection sensor 56. Note here that the control unit 12 performs control such that an electrostatic latent image for use in determination of a preceding control time period is formed before a developing roller 64Y is brought into contact with a photosensitive member 61Y, and, when the developing roller 64Y is brought into contact with the photosensitive member 61Y, the electrostatic latent image is immediately developed. A calculated time E refers to a time period from the development of the electrostatic latent image on the photosensitive member 61Y into a toner image until when this toner image is detected by the detection sensor 56. In this case, a time period X for contact, which is from the start of activation of the stepping motor 91 until when the developing roller 64Y is brought into contact with the photosensitive member 61Y, can be obtained by the formula X=D−E. Note that the amount of time E is stored in advance in the control unit 12.

Subsequently, the control unit 12 obtains a preceding control time period Y by subtracting, from the time period X for contact, a time period F, which is from when the developing roller 64Y is started to rotate due to coupling to the clutch until when the developing roller 64Y is brought into contact with the photosensitive member 61Y. Note that, taking into consideration variations of individual apparatuses, the maximum value is used for the time period F between the start of the rotation and the contact of the developing roller 64Y. With this configuration, it is possible to let the developing roller 64Y stand by at a position before the developing roller 64Y rotates, even if controlling the stepping motor 91 for the preceding control time period Y. Note that this time period F is obtained based on values measured in advance for a plurality of image forming apparatuses and is stored in the control unit 12. Note that the reason why the preceding control time period Y is obtained based on the yellow toner image is that, in the image forming apparatus of the present embodiment, the photosensitive member 61Y that corresponds to yellow is arranged on the most upstream side in the direction in which the surface of the intermediate transfer belt 51 moves. That is, the toner image of the photosensitive member 61Y is first transferred to the intermediate transfer belt 51. Accordingly, the toner color for use in the calculation of the preceding control time period Y depends on the configuration of the image forming apparatus.

Figure 9:
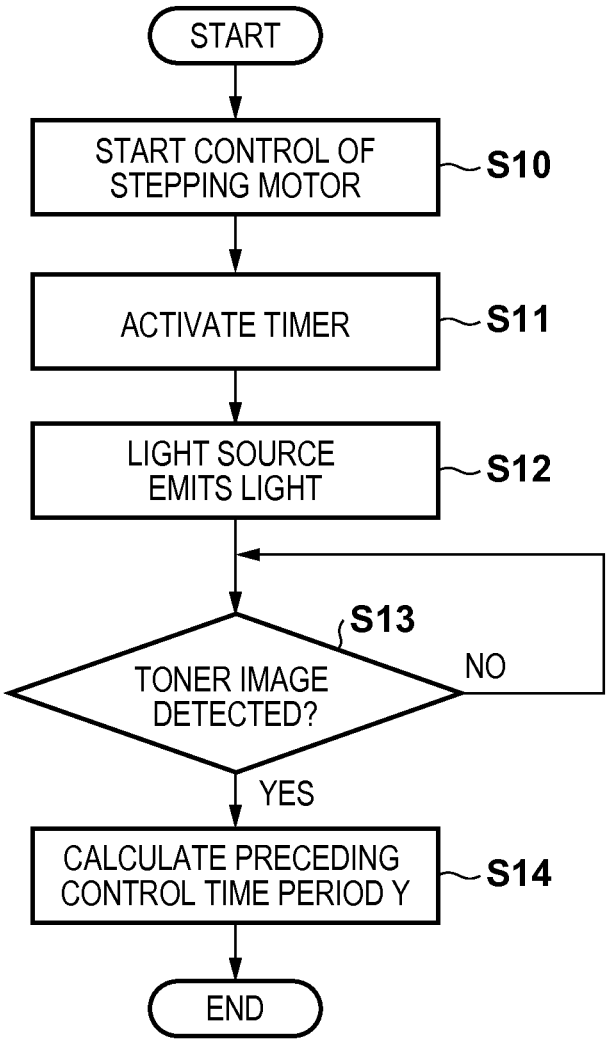
FIG. 9 is a flowchart illustrating processing for calculating a preceding control time period according to an embodiment.

FIG. 9 is a flowchart illustrating processing for calculating the preceding control time period Y. The processing of FIG. 9 is executed when, for example, a door through which a process cartridge is exchanged is closed or when the image forming apparatus is turned on. The control unit 12 starts control of the stepping motor 91 in step S10, and activates a timer in step S11. Then, in step S12, the light source 103 is controlled to emit light and an electrostatic latent image is formed on the photosensitive member 61. Note that the step S12 is performed before the developing roller 64 is brought into contact with the photosensitive member 61. The control unit 12 stands by, in step S13, until the detection sensor 56 detects the toner image. When the detection sensor 56 has detected the toner image, the control unit 12 calculates, in step S14, the preceding control time period Y in the above-described manner based on the time period D between the start of control of the stepping motor 91 and the detection of the toner image by the detection sensor 56, and stores the calculated preceding control time period Y in the RAM 123.

Note that, in the present embodiment, after the start of the image forming processing, the developing roller 64Y in the standby state is moved toward the photosensitive member 61Y, and is stopped at a stop position before the developing roller 64Y is driven to rotate. However, the stop position may be a position after the developing roller 64Y was driven to rotate, as long as the developing roller 64Y is not put into the contact state.

Third Embodiment

The present embodiment is provided to reduce the number of processes for calculating the preceding control time period Y according to the second embodiment. Hereinafter, the present embodiment will be described, focusing on differences from the second embodiment.

The process cartridges of the image forming apparatus described with reference to FIG. 1 each include a nonvolatile memory (NVRAM) in which a serial number, a print count, and the like are stored as shown in FIG. 10A. Furthermore, the control unit 12 includes the main body NVRAM 124 as shown in FIG. 4. The main body NVRAM 124 has stored therein, as shown in FIG. 10B, a serial number of the process cartridge that is currently used in the image forming apparatus and a preceding control time period Y, which has been described in the second embodiment.

Figure 11:
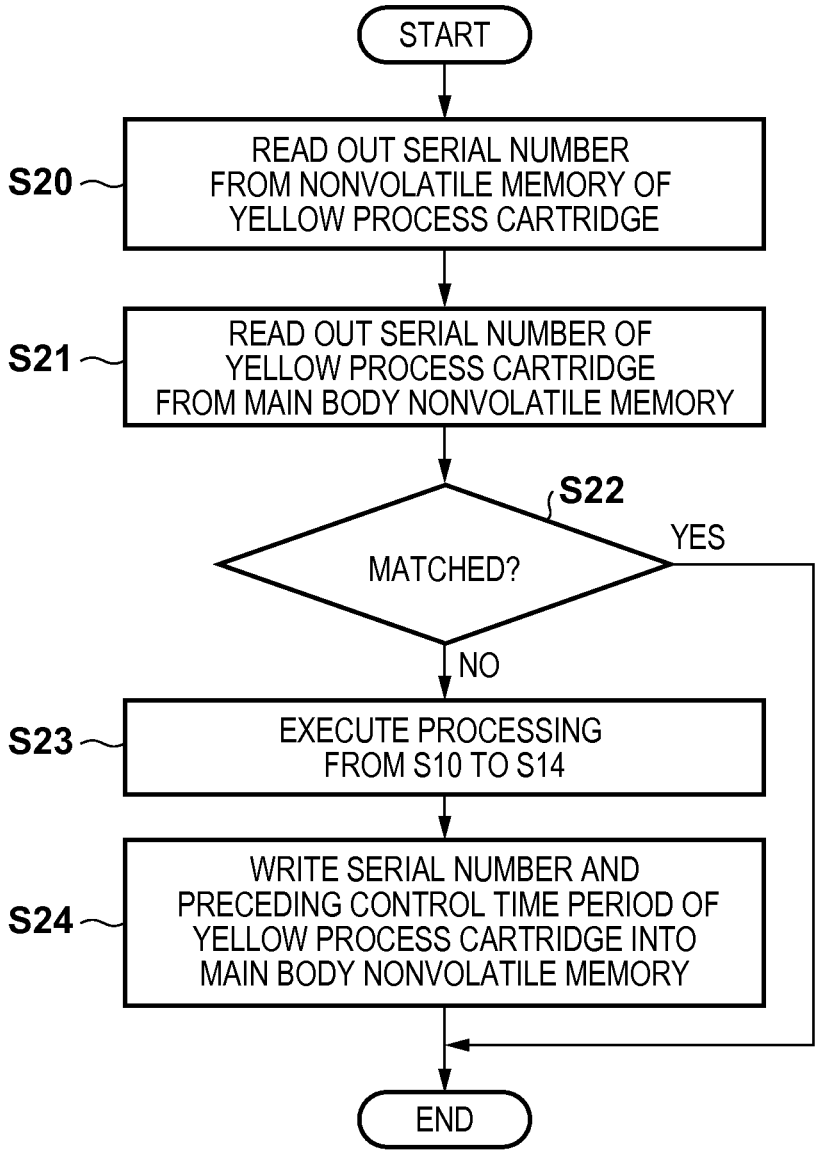
FIG. 11 is a flowchart illustrating processing for calculating a preceding control time period according to an embodiment.

Processing according to the present embodiment will now be described with reference to FIG. 11. The processing of FIG. 11 is executed when, for example, a door through which a process cartridge is exchanged is closed or when the image forming apparatus is turned on. The control unit 12 reads out, in step S20, the serial number from the NVRAM of the yellow process cartridge, and reads out, in step S21, the serial number of the yellow process cartridge stored in the main body NVRAM 124. The control unit 12 determines, in step S22, whether or not the serial numbers that were read out in steps S20 and S21 match each other. If the serial numbers do not match each other, the control unit 12 executes, in step S23, the processing shown in FIG. 9 and obtains a preceding control time period Y. Then, the control unit 12 updates the serial number of the yellow process cartridge in the main body NVRAM 124 to the value read out in step S20, and updates the preceding control time period Y in the main body NVRAM 124 to the value obtained in step S23. Then, the preceding control time period Y obtained in step S23 is used in the subsequent image formation. On the other hand, if it is determined in step S22 that the serial numbers match each other, image formation is performed using the preceding control time period Y stored in the main body NVRAM 124.

With the above-described configuration, the calculation of the preceding control time period Y can be limited to be performed when the yellow process cartridge has been exchanged, allowing a reduction in user's waiting time during which calculation of the preceding control time period Y is performed.

Fourth Embodiment

In the second embodiment, the preceding control time period Y is determined based on a time period from the start of control of the stepping motor 91 until when the detection sensor 56 detects the toner image. In the present embodiment, the preceding control time period Y is determined by monitoring the rotating speed of a DC brushless motor for driving the developing roller 64. Hereinafter, the description of the present embodiment is given, focusing on differences from the second embodiment.

Figure 12:
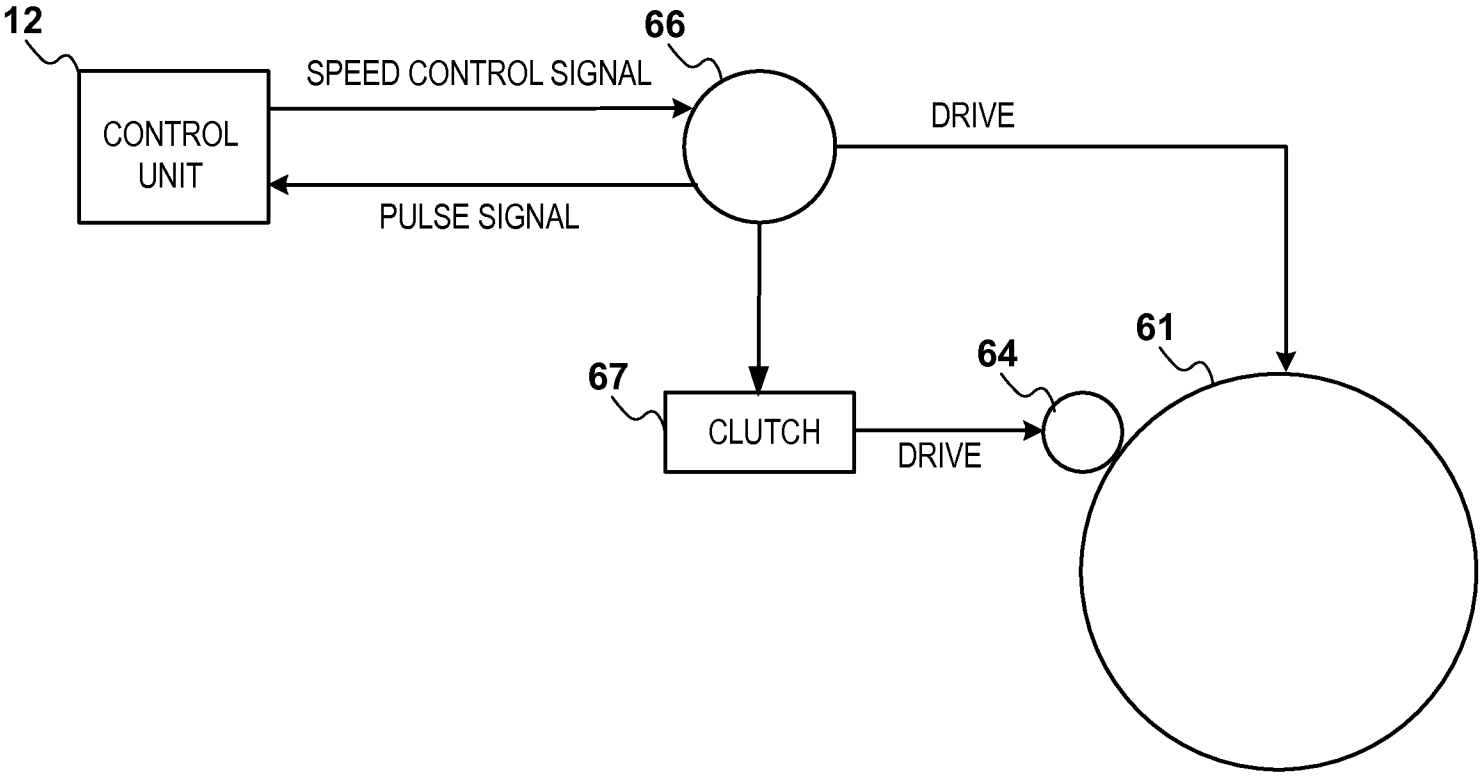
FIG. 12 is a diagram illustrating a configuration for driving the photosensitive member and the developing roller according to an embodiment.

FIG. 12 shows a configuration for driving the photosensitive member 61 and the developing roller 64 to rotate. The control unit 12 determines the rotating speed of the DC brushless motor 66 based on a pulse signal output by the DC brushless motor 66, and outputs, to the DC brushless motor 66, a speed control signal for controlling the DC brushless motor 66 to have the rotating speed of a target value. The DC brushless motor 66 rotates the photosensitive member 61. Furthermore, as described with reference to FIG. 2, the developing roller 64 is coupled to a clutch 67 as it moves forward the photosensitive member 61, and is driven to rotate by the DC brushless motor 66.

Figure 13:
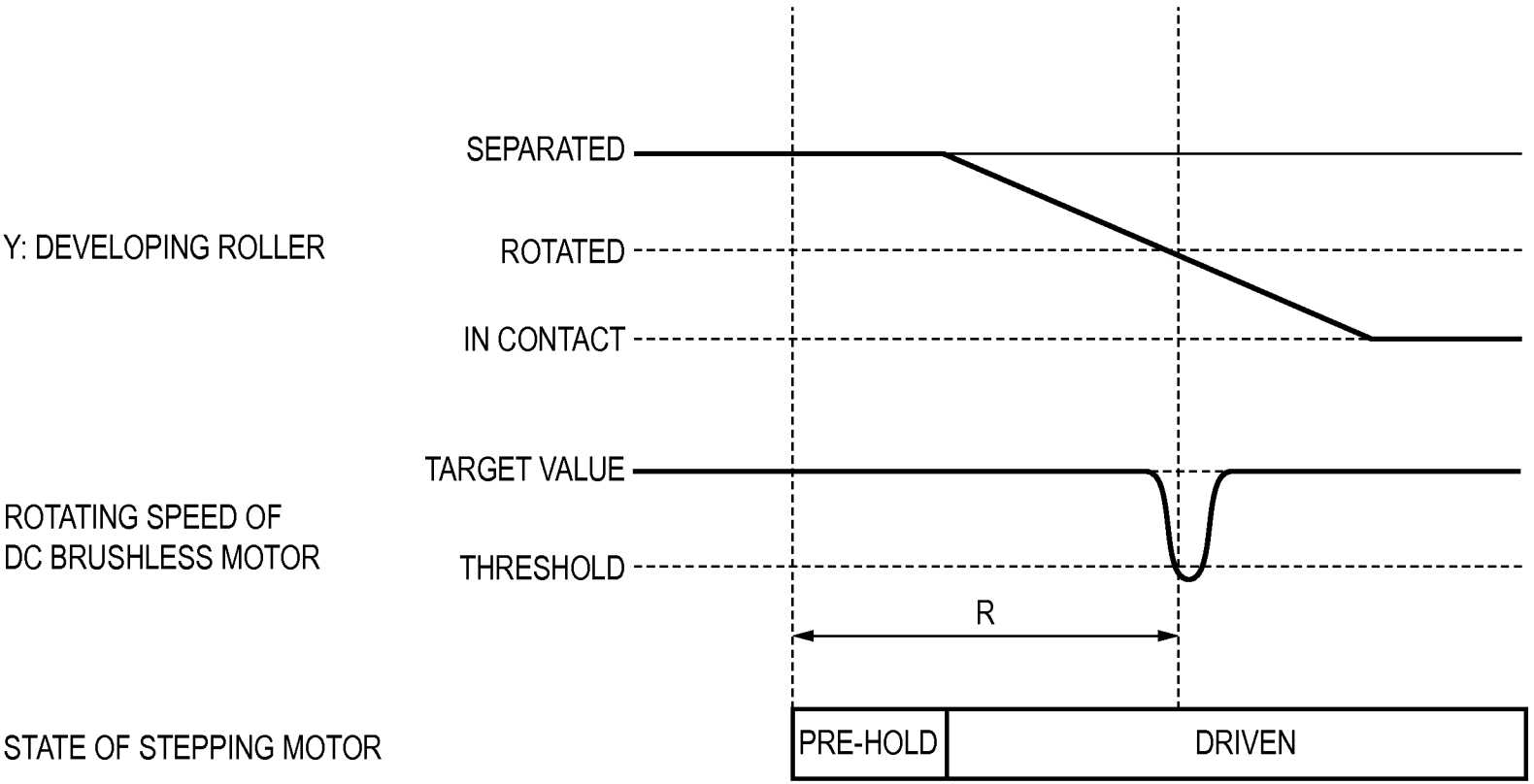
FIG. 13 is a diagram illustrating how to calculate a preceding control time period according to an embodiment.

Subsequently, description is given as to how to determine the preceding control time period Y according to the present embodiment with reference to FIG. 13. As shown in FIG. 13, when control of the stepping motor 91 has started and a pre-hold operation is completed, the developing roller 64Y moves toward the photosensitive member 61Y, and is coupled to the clutch 67 when a time period R has elapsed. As shown in FIG. 13, by the developing roller 64Y being coupled to the clutch 67, the rotating speed of the DC brushless motor 66 is reduced temporarily. Therefore, the coupling of the developing roller 64Y to the clutch 67 is detected by comparing the rotating speed of the DC brushless motor 66 with a threshold. More specifically, the control unit 12 measures the time period R, which is from the start of activation of the stepping motor 91 until the rotating speed of the DC brushless motor 66 is at the threshold or less.

The preceding control time period Y can be obtained by subtracting, from the time period R, the maximum value of time periods due to variations of individual image forming apparatuses. Note that the maximum value is stored in advance in the main body NVRAM by the control unit 12.

Figure 14:
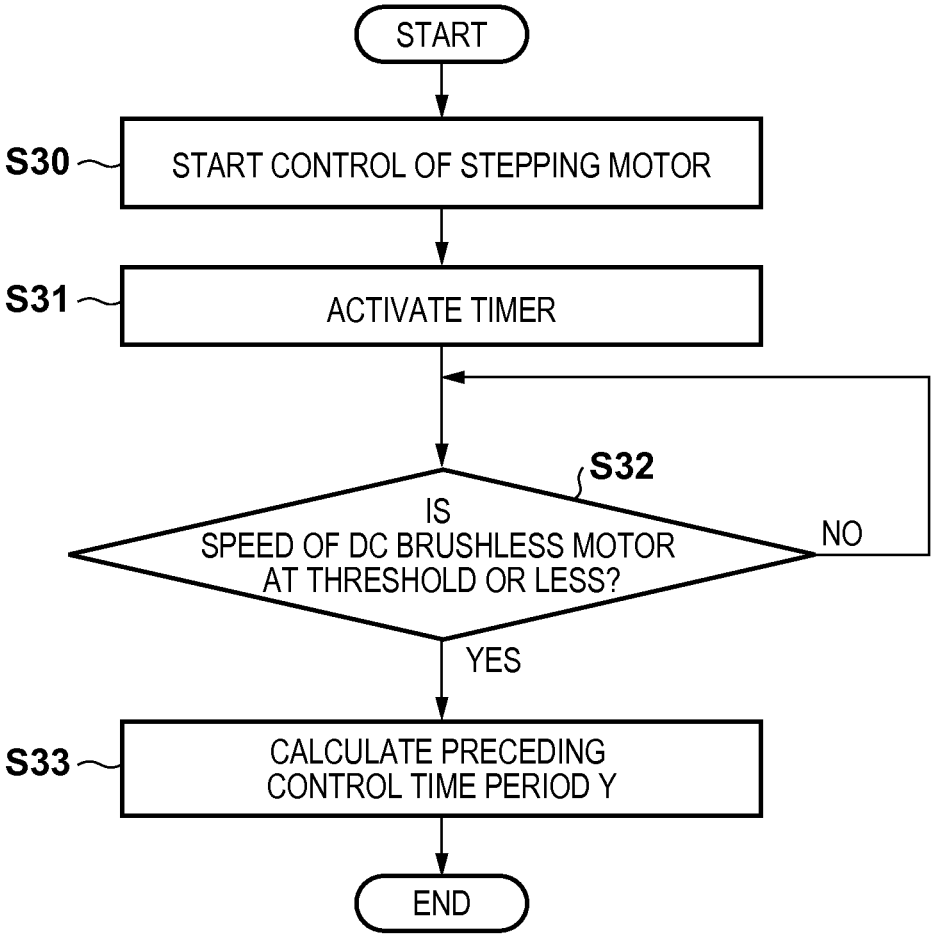
FIG. 14 is a flowchart illustrating processing for calculating a preceding control time period according to an embodiment.

FIG. 14 is a flowchart illustrating processing for calculating the preceding control time period Y according to the present embodiment. The processing of FIG. 14 is executed when, for example, a door through which a process cartridge is exchanged is closed or when the image forming apparatus is turned on. The control unit 12 activates the stepping motor 91 in step S30, and activates a timer in step S31. Then, it is determined in step S32 whether or not the rotating speed of the DC brushless motor 66 is at a threshold or less. If the rotating speed of the DC brushless motor 66 is at a threshold or less, the control unit 12 calculates, in step S33, the preceding control time period Y in the above-described manner based on the value of the timer, and stores the calculated preceding control time period Y in the main body NVRAM 124.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-126122, filed on Jun. 14, 2013, which is hereby incorporated by reference herein in its entirety.

What is claimed is:

1. An image forming apparatus comprising:

a photosensitive member;

a scanning unit including a light source, and configured to scan the photosensitive member with light from the light source and to form an electrostatic latent image;

a developing unit configured to develop the electrostatic latent image by contacting with the photosensitive member;

a driving unit configured to drive the developing unit, and to cause the developing unit to come into contact with the photosensitive member or to be separated from the photosensitive member; and a control unit configured to let the scanning unit perform a preparation operation, in order for the scanning unit to form the electrostatic latent image based on image data, wherein the developing unit is separated from the photosensitive member while the preparation operation of the scanning unit is performed, the control unit is further configured to start, before the preparation operation of the scanning unit is completed, controlling the driving unit to bring the separated developing unit into contact with the photosensitive member, and the control unit is further configured to let the driving unit bring the developing unit into contact with the photosensitive member after the completion of the preparation operation of the scanning unit.

2. The image forming apparatus according to claim 1, wherein the scanning unit is further configured to perform, at the completion of the preparation operation, unblanking light emission in which the light source emits light at a timing at which the photosensitive member is not scanned.

3. The image forming apparatus according to claim 1, wherein the control unit is further configured to perform, before the preparation operation of the scanning unit is completed, preparation processing of the driving unit for moving the developing unit toward the photosensitive member.

4. The image forming apparatus according to claim 1, wherein the control unit is further configured to stop the developing unit at a stop position, at which the developing unit does not come into contact with the photosensitive member, after the driving unit has started moving the developing unit toward the photosensitive member and before the preparation operation of the scanning unit is completed.

5. The image forming apparatus according to claim 4, wherein the developing unit is further configured to be driven to rotate at a predetermined position before being brought into contact with the photosensitive member, and the developing unit is not driven to rotate at the stop position.

6. An image forming apparatus comprising:

a photosensitive member;

a scanning unit including a light source, and configured to scan the photosensitive member with light from the light source and to form an electrostatic latent image;

a developing unit configured to develop the electrostatic latent image to a developer image by contacting with the photosensitive member;

a driving unit configured to drive the developing unit and to cause the developing unit to come into contact with the photosensitive member or to be separated from the photosensitive member; and a control unit configured to let the scanning unit perform a preparation operation for the scanning unit to form the electrostatic latent image based on image data, and to control, before the preparation operation of the scanning unit is completed, the driving unit for a predetermined preceding control time period so as to move the developing unit separated from the photosensitive member toward the photosensitive member to an extent in which the developing unit and the photosensitive member are not brought into contact with each other, wherein the control unit is further configured to determine the preceding control time period by starting, before the preparation operation of the scanning unit is completed, controlling the driving unit to bring the developing unit into contact with the photosensitive member, forming the electrostatic latent image on the photosensitive member before the developing unit is brought into contact with the photosensitive member, forming the developer image on the photosensitive member by developing the electrostatic latent image formed on the photosensitive member by the developing unit contacted with the photosensitive member, and measuring a time period until the developer image formed on the photosensitive member reaches a predetermined position.

7. The image forming apparatus according to claim 6, further comprising a transfer body that is driven to rotate, and to which the developer image formed on the photosensitive member is to be transferred, wherein the control unit is further configured to determine the preceding control time period by measuring a time period until the developer image formed on the photosensitive member is transferred to the transfer body and reaches a predetermined position.

8. The image forming apparatus according to claim 7, wherein the control unit is further configured to start a control for determining the preceding control time period when the photosensitive member or the developing unit has been exchanged.

9. The image forming apparatus according to claim 8, wherein a photosensitive member and a developing unit are provided corresponding to each color used for image formation, and a first photosensitive member, on which a developer image for use in the determination of the preceding control time period is formed, is a photosensitive member whose developer image is transferred to the transfer body at a most upstream position in a rotation direction of the transfer body, and the control unit is further configured to start the control for determining the preceding control time period when the first photosensitive member or the developing unit for developing the electrostatic latent image on the first photosensitive member has been exchanged.

10. An image forming apparatus comprising:

a photosensitive member;

a scanning unit including a light source, and configured to scan the photosensitive member with light from the light source and to form an electrostatic latent image;

a developing unit configured to develop the electrostatic latent image by contacting with the photosensitive member;

a driving unit configured to drive the developing unit and to cause the developing unit to come into contact with the photosensitive member or to be separated from the photosensitive member; and a control unit configured to let the scanning unit perform a preparation operation for the scanning unit to form the electrostatic latent image based on image data, and to control, before the preparation operation of the scanning unit is completed, the driving unit for a predetermined preceding control time period so as to move the developing unit toward the photosensitive member to an extent in which the developing unit and the photosensitive member are not brought into contact with each other, wherein the developing unit is configured to be driven to rotate at a predetermined position before being brought into contact with the photosensitive member, and the control unit is further configured to determine the preceding control time period by detecting when the developing unit is driven to rotate.

11. An image forming apparatus comprising:

a photosensitive member;

a scanning unit including a light source, and configured to scan the photosensitive member with light from the light source and to form an electrostatic latent image;

a developing unit configured to develop the electrostatic latent image by contacting with the photosensitive member;

a driving unit configured to drive the developing unit, and to cause the developing unit to come into contact with the photosensitive member or to be separated from the photosensitive member; and a control unit configured to let the scanning unit perform a preparation operation, in order for the scanning unit to form the electrostatic latent image based on image data, wherein the developing unit is separated from the photosensitive member while the preparation operation of the scanning unit is performed, and the control unit is further configured to let the driving unit start driving the developing unit to cause the developing unit to be close to the photosensitive member before the preparation operation of the scanning unit is completed, and to let the driving unit stop driving before the developing unit and the photosensitive member are contacted.

12. The image forming apparatus according to claim 11, wherein the scanning unit is further configured to perform, at the completion of the preparation operation, unblanking light emission in which the light source emits light at a timing at which the photosensitive member is not scanned.

13. The image forming apparatus according to claim 11, wherein the control unit is further configured to stop the developing unit at a stop position, at which the developing unit does not come into contact with the photosensitive member, after the driving unit has started moving the developing unit toward the photosensitive member and before the preparation operation of the scanning unit is completed.

14. The image forming apparatus according to claim 13, wherein the developing unit is further configured to be driven to rotate at a predetermined position before being brought into contact with the photosensitive member, and the developing unit is not driven to rotate at the stop position.

15. The image forming apparatus according to claim 11, wherein the control unit is further configured to let the driving unit bring the developing unit into contact with the photosensitive member at the completion of the preparation operation of the scanning unit.

* * * * *